US006409165B1

(12) United States Patent
Yamaoka et al.

(10) Patent No.: US 6,409,165 B1
(45) Date of Patent: Jun. 25, 2002

(54) SHEET HOLDER AND SHEET TRAILING EDGE RESTRICTION MEMBER THEREFOR

(75) Inventors: Masanori Yamaoka; Yuji Nakayashiki; Hiroyuki Tanaka, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 131 days.

(21) Appl. No.: 09/633,267

(22) Filed: Aug. 4, 2000

(30) Foreign Application Priority Data

Aug. 6, 1999 (JP) ..... 11-223669

(51) Int. Cl.[7] ..... B65H 1/00

(52) U.S. Cl. ..... 271/145; 271/160; 271/127; 271/147; 271/169; 271/171

(58) Field of Search ..... 271/145, 160, 271/171, 167, 169, 127, 147, 241

(56) References Cited

U.S. PATENT DOCUMENTS 4,359,215 A * 11/1982 Ruenzi ..... 271/162 X
5,632,477 A * 5/1997 Morinaga ..... 271/127
5,815,787 A * 9/1998 Crayton et al. ..... 271/160 X
5,884,136 A * 3/1999 Takei et al. ..... 271/127 X
6,039,315 A * 3/2000 Lim ..... 271/160

* cited by examiner

*Primary Examiner*—Joseph E. Valenza
*Assistant Examiner*—Richard Ridley
(74) *Attorney, Agent, or Firm*—Smith, Gambrell & Russell, LLP

(57) ABSTRACT

A sheet trailing edge restriction member (65) according to the present invention has a main body (68) disposed upright in a sheet holding portion. The main body (68) is provided with a hook (71) for fixing the main body upright to the sheet holding portion. The restriction member is attached to and detached from the sheet holding portion by deforming the hook (71) toward a space (72) defined between the hook and the main body. Unless the hook is deformed toward the space (72), the restriction member cannot be detached from the sheet holding portion. The main body (68) is provided with a rear support plate (70) for supporting a rear end of a sheet stack. The rear support plate (70) is displaceable so as to support the rear end of the sheet stack. An insert (82) is provided integrally with the rear support plate (70). The insert (82) is usually inserted in the space (72) to prevent the deformation of the hook (71).

6 Claims, 6 Drawing Sheets

SHEET HOLDER AND SHEET TRAILING EDGE RESTRICTION MEMBER THEREFOR

This application is based on application No. 11-223669 filed in Japan, the content of which is incorporated herein by reference.

BACKGROUND OF THE INVENTION

1. Field of the Invention

The present invention relates to a sheet trailing edge restriction member which is applicable to sheet feeder trays and sheet cassettes of image forming apparatuses such as copying machines, facsimile machines and printers.

2. Description of Related Art

Image forming apparatuses generally have a sheet holding member called "sheet tray", "sheet feeder cassette" or "sheet cassette" (hereinafter referred to generally as "sheet cassette"). Most of modern sheet cassettes are adapted to accommodate a great number of sheets, for example, 500 sheets.

The sheets are fed out of the sheet cassette one by one in order from the top. For prevention of feed-out of plural sheets at a time, the sheet cassette is provided with separation claws. The separation claws project on the sheet stack to catch opposite ends of an upper front edge of the sheet stack.

The sheet cassette further has a bias plate which is adapted to bias a front portion of the sheet stack upward in the sheet cassette to lift the front portion of the sheet stack. Therefore, the sheet stack is lifted by the bias plate with the opposite ends of the upper front edge thereof caught by the separation claws.

Where a great number of sheets (e.g., 500 sheets) are accommodated in the sheet cassette, the sheet stack P is not lifted by the bias plate 63 as shown in FIG. 6A. As the thickness of the sheet stack P is reduced with a reduced number of sheets held in the sheet cassette, the bias plate 63 lifts the front portion of the sheet stack P to a higher level to press the front upper portion of the sheet stack against the separation claws 66 as shown in FIG. 6B. Therefore, the sheet stack P should be supported at its rear end with the front portion thereof being lifted.

Where the sheet cassette is adapted to accommodate an increased number of sheets, the weight of the sheet stack held in the sheet cassette is increased. Therefore, a restriction member 30 for positioning the trailing edges of the sheets should firmly be fixed upright on a bottom face 31 of the sheet cassette so as not to be disengaged from the bottom face 31. On the other hand, the sheet trailing edge restriction member 30 should be mountable at different positions in the sheet cassette depending on the size of the sheets. Therefore, the sheet trailing edge restriction member 30 is preferably constructed such that its mounting position can easily be changed.

That is, the sheet trailing edge restriction member 30 preferably has such a construction that its mounting position can easily be changed and, once it is mounted in position, it can assuredly support the rear end of the stack P of a great number of sheets held in the sheet cassette without easily disengaging therefrom.

SUMMARY OF THE INVENTION

In view of the technical background described above, it is an object of the invention to provide a sheet trailing edge restriction member which is capable of assuredly supporting a rear end of a sheet stack held in a sheet holder, and to provide a sheet holder having such a sheet trailing edge restriction member.

It is another object of the invention to provide a sheet trailing edge restriction member which can easily be attached to and detached from a sheet holder and, once it is mounted in the sheet holder, can assuredly support a sheet stack held in the sheet holder without disengagement thereof.

In accordance with the present invention, there is provided a sheet holder which comprises a sheet holding portion and a restriction member mounted in a predetermined position of the sheet holding portion for positioning a rear end of a sheet stack held in the sheet holding portion. The restriction member comprises: a main body disposed upright in the sheet holding portion; a hook extending alongside the main body with a predetermined space defined therebetween for fixing the main body to the sheet holding portion, the hook being deformable toward the main body (toward the space) so as to be brought into and out of engagement with the sheet holding portion; a rear support plate forwardly displaceable from the main body so that, when the sheet stack has a greater thickness with a greater number of sheets held in the sheet holding portion, the rear support plate is pressed against the main body by the rear end of the sheet stack thereby to be substantially flush with the main body and, as the number of the sheets is reduced, the rear support plate is displaced forward from the main body to support the rear end of the sheet stack; and an insert projecting from the rear support plate to be inserted in the space between the main body and the hook, the insert being movable in accordance with the displacement of the rear support plate so as to be brought out of the space when the rear support plate is displaced to a forward terminal position.

With this arrangement, when the insert is inserted in the space between the main body and the hook of the restricting member, the hook cannot be deformed toward the main body. This is because the hook can be deformed toward the main body only when the predetermined space is present between the hook and the main body. When the space is blocked by inserting the insert in the space, the hook cannot be deformed.

Since the main body is disposed upright in the sheet holding portion and the hook is not allowed to be deformed in engagement with the sheet holding portion, the main body, i.e., the sheet trailing edge restriction member will not be disengaged from the sheet holder.

In the present invention, the insert to be inserted in the space is integral with the rear support plate, and shifted between a state where the insert is inserted in the space and a state where the insert is out of the space in accordance with the displacement of the rear support plate for switching the hook between a deformable state and a nondeformable state. More specifically, when the sheet stack has a greater thickness with a greater number of sheets being held in the sheet holding portion, the rear support plate is substantially flush with the main body. At this time, the insert is inserted in the space between the main body and the hook. Even if the sheet stack having a greater thickness exerts a force on the main body by gravity with its rear end contacting the main body in this state, the hook is prevented from being deformed and disengaged from the sheet holding portion. Therefore, the sheet trailing edge restriction member is not disengaged from the sheet holding portion.

When the rear support plate is displaced to the forward terminal position, the insert is withdrawn from the space, so that a user can deform the hook toward the main body. Thus, the user can detach the sheet trailing edge restriction member from the sheet holding portion, and easily change the mounting position of the restriction member.

In the sheet trailing edge restriction member which can easily be attached to and detached from the sheet holding portion by deforming the fixing hook toward the space, the hook is not allowed to be deformed with the space blocked by the insert to prevent the restriction member from being disengaged from the sheet holding portion. The insert to be inserted in the space is integral with the rear support plate thereby to be movable in association with the rear support plate. Therefore, even when a greater number of sheets are held in the sheet holding portion, the hook is not deformed, so that the sheet trailing edge restriction member is not disengaged from the sheet holding member.

Further, the rear support plate and the insert are not separate components but the sheet trailing edge restriction member is constructed as a unitary member. Therefore, there is no possibility that any components of the restriction member become missing due to frequent positional change of the restriction member.

One embodiment of the present invention will hereinafter be described in detail with reference to the attached drawings.

DESCRIPTION OF THE PREFERRED EMBODIMENTS

Figure 1:
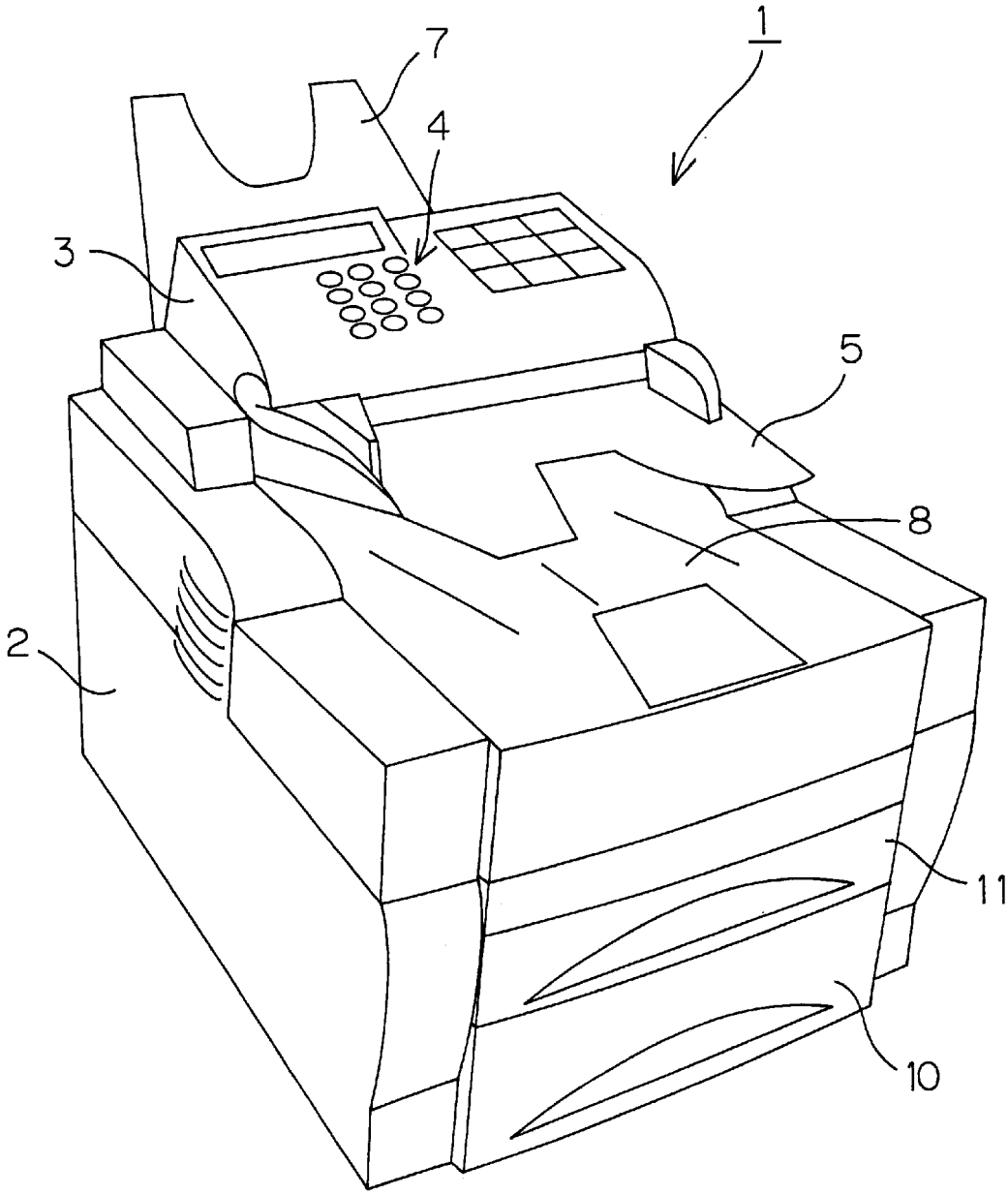
FIG. 1 is a perspective view illustrating the exterior construction of an image forming apparatus which employs a sheet cassette having a sheet trailing edge restriction member according to one embodiment of the invention.

FIG. 1 is a perspective view illustrating the exterior construction of an image forming apparatus 1 which employs a sheet cassette having a sheet trailing edge restriction member according to one embodiment of the invention. The image forming apparatus 1 is a multi-function apparatus which is basically used as a facsimile machine an d usable as a printer and a copying machine. The image forming apparatus 1 has a main housing 2, a document reading section 3 provided on the main housing 2, and an operation panel 4 provided on the top of the document reading section 3 and having ten keys, function keys, display and the like arranged thereon. A document holding plates projects forward (toward the right forward side in FIG. 1) from the document reading section 3. Document originals placed on the document holding plate 5 are taken into the document reading section one by one in a so-called sheet-through manner. After images on the document originals are read, the document originals are received on a document receiving tray 7 provided behind the housing.

An upper surface portion of the main housing 2 located below the document holding plate 5 serves as a sheet discharge portion 8 for receiving image-formed sheets.

The image forming apparatus 1 is accessible from the forward side (front side) thereof for replenishment of sheets, sheet jam recovery and replenishment of a toner. In this respect, a drawable sheet cassette 10 is fitted in a lower front portion of the main housing 2. Further, a two-side guide member 11 is fitted in a forwardly drawable and removable manner above the sheet cassette 10 in the main housing.

Figure 2:
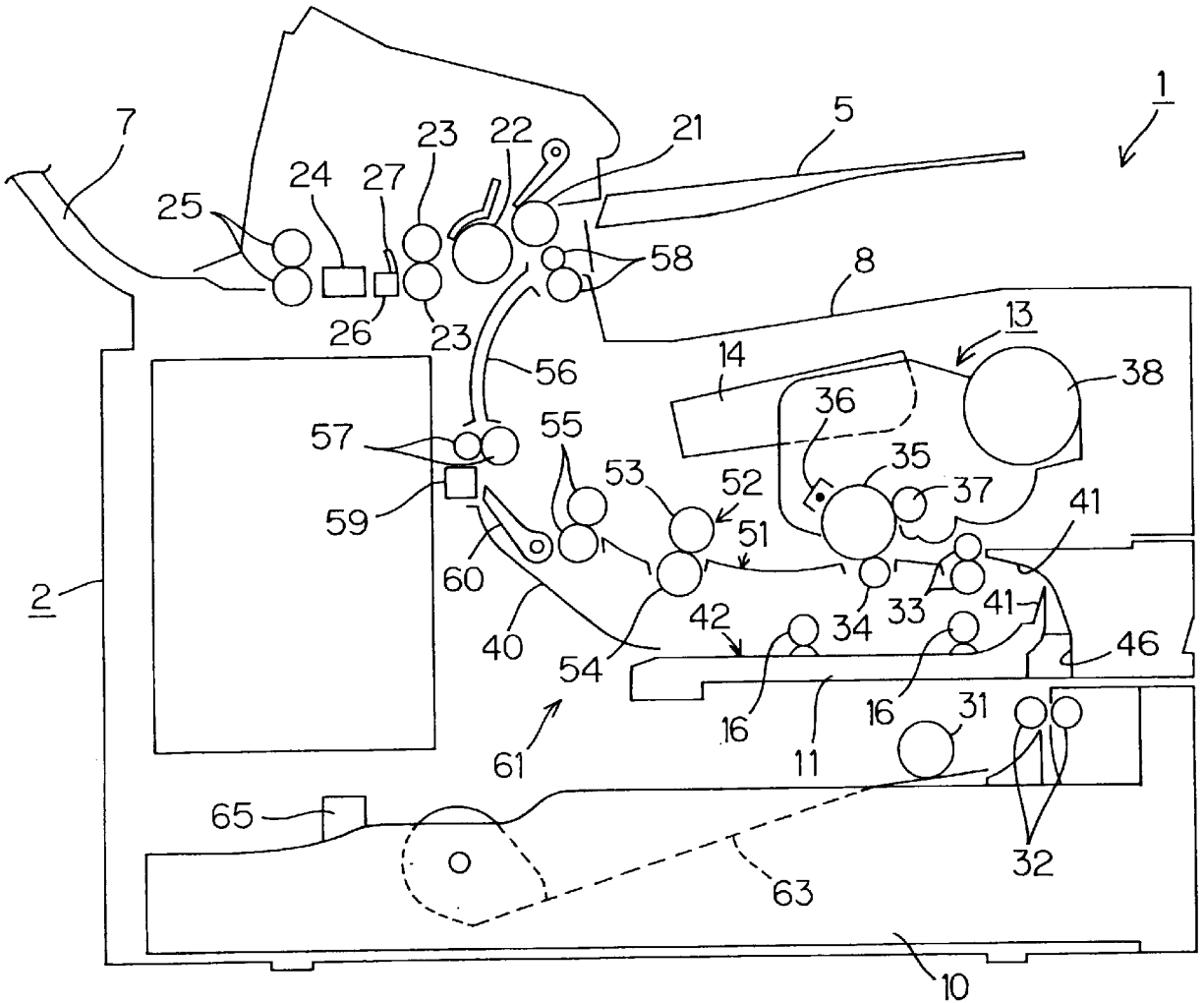
FIG. 2 is a vertical sectional view for explaining the internal construction of the image forming apparatus.

FIG. 2 is a vertical sectional view for explaining the internal construction of the image forming apparatus 1. Referring to FIG. 2, an explanation will be given to the construction of the image forming apparatus 1.

Document originals are set face down on the document holding plate 5. The document originals thus set (not shown) are fed out in order from the bottom by a feed roller 21, and separated one from the other by a separation roller 22 for prevention of plural document feeding. The document original is sent to a reading sensor 24 at a predetermined speed by a guide roller pair 23. In this embodiment, a CIS (contact image sensor) is employed as the reading sensor 24, by which an image on the document original is read perpendicularly to the face of the drawing of FIG. 2 on a line-by-line basis along the length thereof. The document original passed through the reading sensor 24 is discharged onto the document receiving tray 7 by a discharge roller pair 25. An actuator 27 of a micro-switch 26 projects into a document transport path upstream of the reading sensor 24. When the leading edge of the document original is introduced into the document transport path, the actuator 27 is pushed down by the document original. As soon as the document original passes over the actuator, the actuator 27 is raised. Thus, the leading and trailing edges of the transported document original can be detected.

The sheet cassette 10 which is forwardly drawable (to the right side in FIG. 2) from a front face of the main housing is housed in the lower portion of the main housing 2. Sheets (not shown) accommodated in the sheet cassette 10 are taken out on a one-by-one basis by a feed roller 31, and transported to a registration roller pair 33 through a path 46 and a reverse path 41 by a transport roller pair 32. Then, the sheet is transported to a transfer roller 34 with its transport timing adjusted by the registration roller pair 33.

A photoreceptor drum 35 of an image forming unit 13 is opposed to the transfer roller 34. The image forming unit 13 includes, in addition to the photoreceptor drum 35, a main charger 36 for charging the surface of the photoreceptor drum 35, a developer roller 37 for developing into a toner image an electrostatic latent image formed by exposing the charged surface of the photoreceptor drum 35 to a laser beam by a laser unit 14, a toner cartridge 38 for supplying a toner to the developer roller 37, and the like.

The sheet is passed between the photoreceptor drum 35 and the transfer roller 34, whereby the toner image formed on the surface of the photoreceptor drum 35 is transferred onto the sheet.

The sheet carrying the toner image transferred thereon is transported through a main transport path 51 to a fixing unit 52. The fixing unit 52 includes a heat roller 53 and a press roller 54. The sheet is passed between these rollers, whereby the toner image transferred onto the sheet is fused and fixed on the sheet by heat and pressure. The sheet carrying the toner image fixed thereon is transported to the discharge path 56 by an intermediate roller pair 55.

A curl-removal/switch-back roller pair 57 is provided in an upstream portion of the discharge path 56. The roller pair 57 serves to remove a curl of the sheet transported to the discharge path 56 and to switch the sheet back when a two-side image formation is to be performed to form images on opposite sides of the sheet. More specifically, when the sheet is passed through the fixing unit 52, the upper face of the sheet (which carries the image transferred thereon and is brought into contact with the heat roller 53) is thermally contracted mainly by the action of the heat roller 53, so that the sheet is curled with a middle portion thereof projecting downward. Therefore, the sheet is passed between the pair of rollers 57 and softly drawn therebetween so as to be imparted with a reverse curl. Thus, the curl is removed from the sheet. The sheet thus straightened is transported through the discharge path 56 and discharged through the discharge roller pair 58 onto the discharge portion 8.

Where the two-side image formation is performed on the sheet, the trailing edge of the sheet is detected by a detection switch 59 when the sheet is transported from the intermediate roller pair 55 to the curl-removal/switch-back roller pair 57. Since the detection switch 59 is provided adjacent a sheet entrance to the roller pair 57, an output indicative of the detection is given just before the trailing edge of the sheet transported to the roller pair 57 is passed through the roller pair 57. On the basis of the output of the detection switch 59, the curl-removal/switch-back roller pair 57 is reversely rotated and a claw 60 is shifted, whereby the sheet can enter a two-side path 61. Thus, the sheet is transported into the two-side path 61.

The two-side path 61 is provided below the main transport path 51, and includes an introduction path 40, a horizontal path 42 for generally horizontally guiding the sheet toward the front side of the apparatus 1, and a reverse path 41 for reversing the sheet transported from the horizontal path 42 by 180 degrees. The sheet reversed by the reverse path 41 is transported from the registration roller pair 33 to the transfer roller 34 as in the aforesaid manner.

Figure 3:
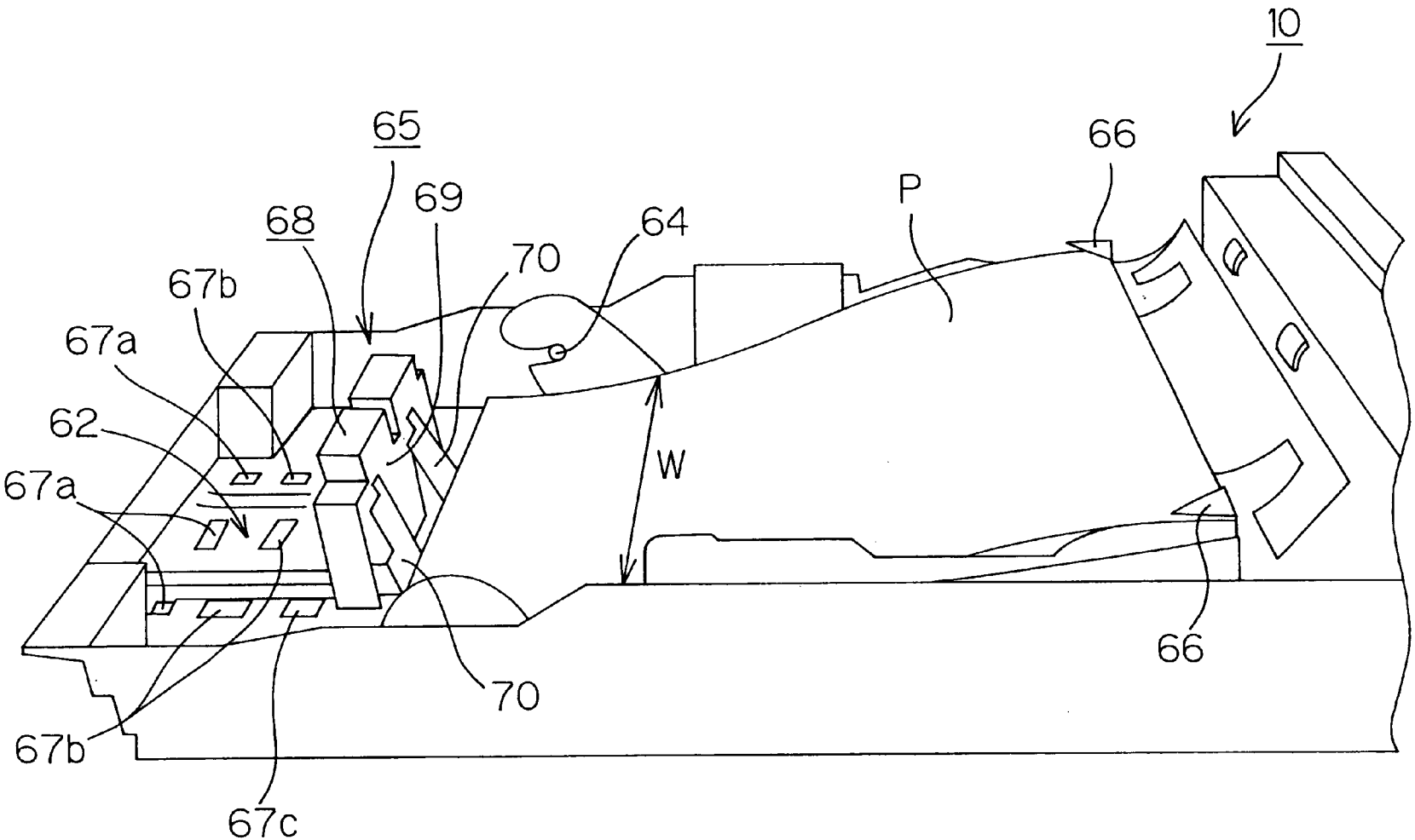
FIG. 3 is a perspective view illustrating the sheet cassette drawn out of the image forming apparatus.

FIG. 3 is a perspective view illustrating the sheet cassette 10 drawn out of the image forming apparatus 1. The sheet cassette 10 is of a shallow rectangular box shape having an open top, and is adapted to accommodate a stack of sheets P. A bias plate 63 (see FIG. 2) is provided on a bottom plate of the sheet cassette on which the sheet stack P is placed. The bias plate 63 is attached pivotally about support pins 64, and a front portion thereof is resiliently biased upward from the lower side by a coil spring or the like not shown. Therefore, the sheets P placed on the bias plate 63 are resiliently biased against the feed roller 31 (see FIG. 2).

A restriction member 65 for positioning the rear end of the sheet stack P accommodated in the sheet cassette 10 is attached to the sheet cassette 10. The restriction member 65 is the inventive component according to the embodiment.

Separation claws 66 abut against an upper surface of the sheet stack P placed on the bias plate 63 so as to be engaged with opposite ends of an upper front edge of the sheet stack. The separation claws 66 serve to separate the uppermost sheet from the other sheets so that the sheets can be fed out one by one in order from the top by the feed roll 31.

The rear end of the sheet stack P is positioned by the aforesaid restriction member 65. The sheet cassette 10 according to this embodiment is adapted to hold plural types of sheets which have a width W of 210 mm (which equals to the width of a JIS A4 size sheet) and different lengths. In this respect, plural sets of attachment holes 67*a*, 67*b*, . . . for receiving the restriction member 65 are provided in the bottom plate 62 of the sheet cassette 10. The restriction member 65 is fixed to any one of the sets of attachment holes (a method for attaching the restriction member will be described later).

The restriction member 65 has a main body 68 and a pair of rear support plates 70 incorporated in a front face 69 of the main body 68. The pair of rear support plates 70 are pivotal so that lower portions thereof move apart from the front face 69 of the main body as shown in FIG. 3 to support the rear end of the sheet stack P, as the thickness of the sheet stack P is reduced.

Figure 4:
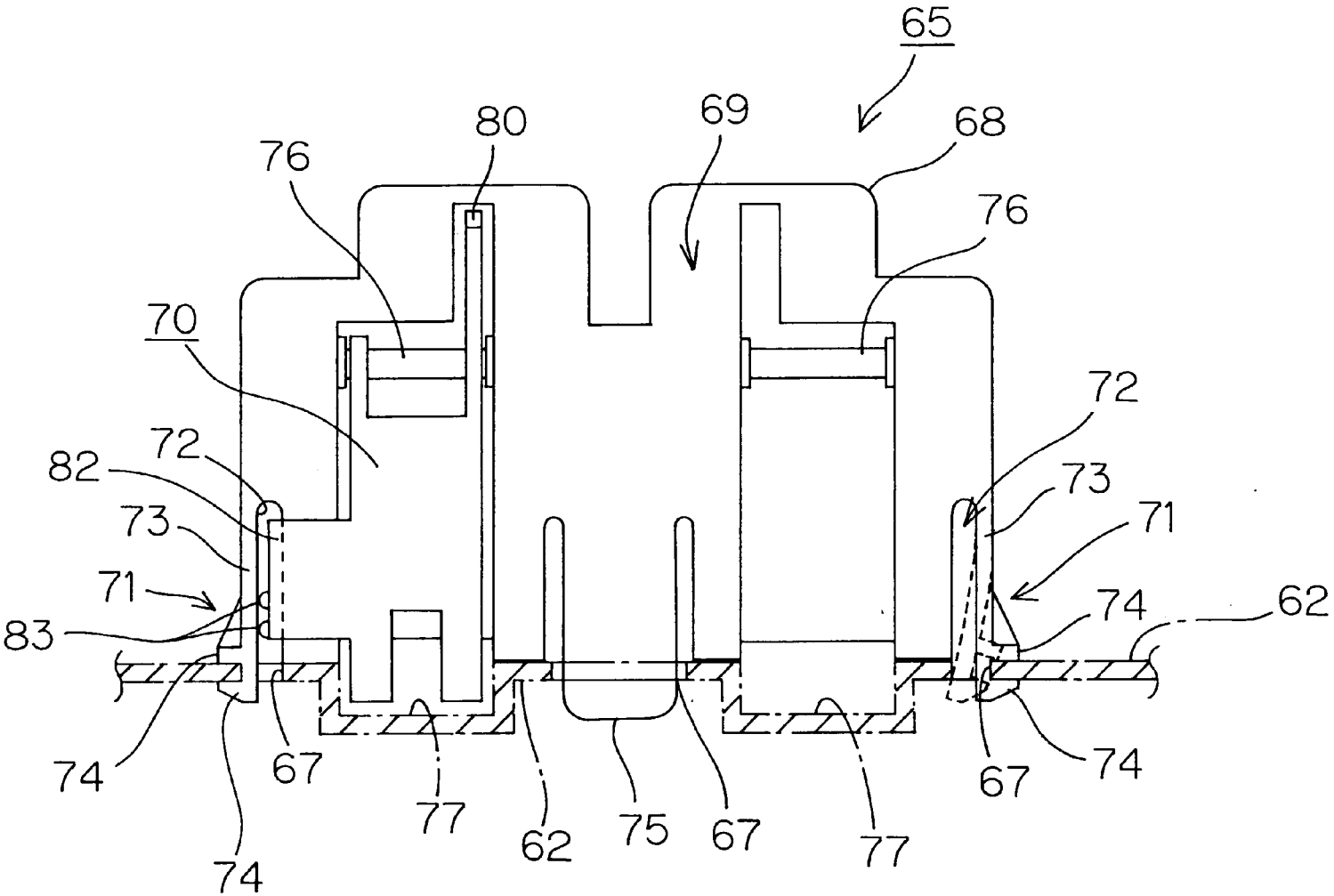
FIG. 4 is a front view of the sheet trailing edge restriction member with a right-hand rear support plate being omitted.
Figure 5A:
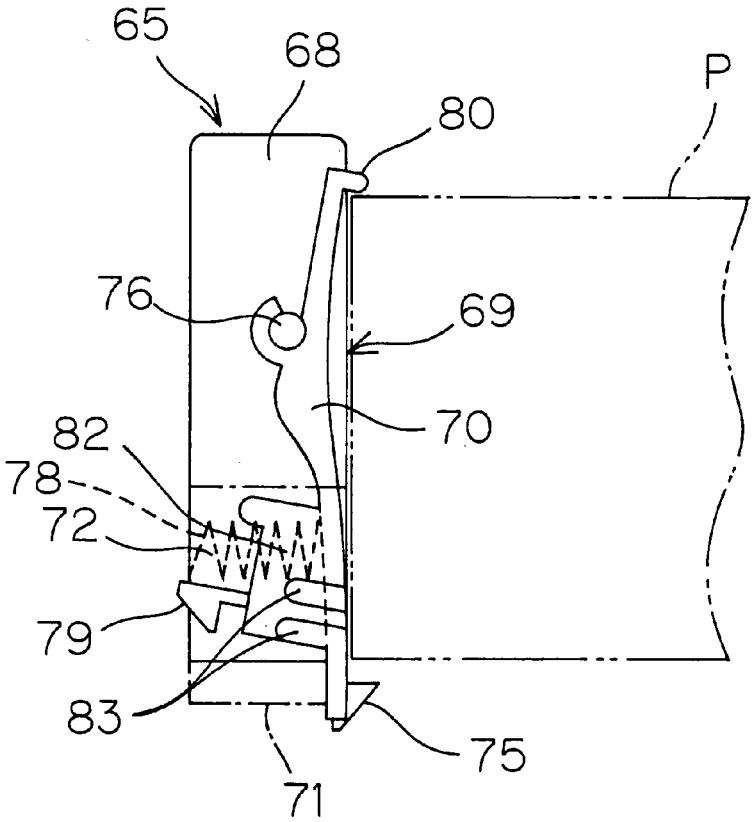
FIGS. 5A and 5B are schematic side sectional views for explaining an operation of rear support plates of the sheet trailing edge restriction member.
Figure 5B:
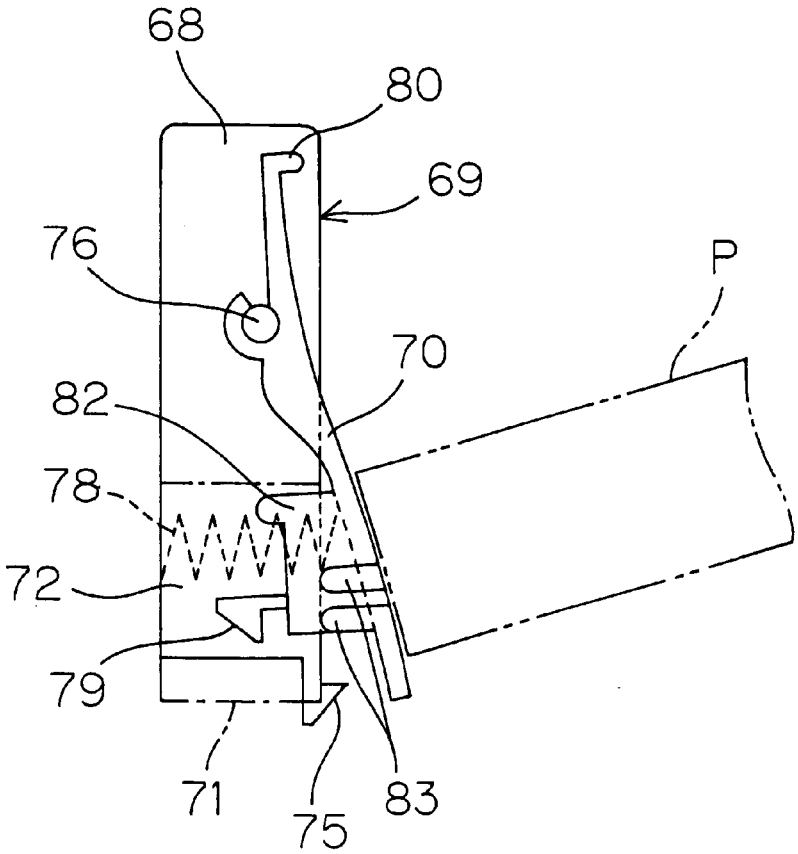

FIG. 4 is a front view of the restriction member 65 (as viewed from the front end of the sheet stack P), in which the right-hand rear support plate 70 is not shown for convenience of explanation. FIGS. 5A and 5B are schematic side sectional views for explaining an operation of the rear support plates of the restriction member 65.

Referring to FIGS. 4, 5A and 5B, the restriction member 65 has a main body 68 such as composed of a resin. As shown in FIG. 3, the main body 68 is attached to a predetermined position of the bottom plate 62 of the sheet cassette 10 as standing upright. Hooks 71 for fixing the main body 68 to the attachment holes 67 are provided alongside laterally opposite side faces of the main body 68. The hooks 71 each have a resilient plate 73 extending alongside the main body 68 with a predetermined space 72 defined therebetween, and claws 74 projecting outward. When the main body 68 is to be attached to the attachment holes 67 in the bottom plate 62, the resilient plates 73 of the hooks 71 are resiliently deformed toward the main body 68 (toward the space 72) so as to be inserted into the corresponding attachment holes 67, as indicated by a broken line by way of the right-hand hook 71. When forces applied to the resilient plates for resilient deformation thereof are removed (more specifically, when an operator takes his hands off the resilient plates), the resilient plates 73 are restored into a straight state, whereby the claws 74 are engaged with the bottom plate 62. Thus, the main body 68 is fixed to the bottom plate 62.

In addition to the lateral hooks 71, a hook 75 provided at a lower middle portion of the front face of the main body 68 is engaged with the corresponding attachment hole 67, so that the main body 68 is fixed to the bottom plate 62 at three points.

The left and right rear support plates 70 in pair are incorporated in the front face 69 of the main body 68 (only the left-hand rear support plate is shown in FIG. 4 as described above). The rear support plates 70 are each attached pivotally about a support shaft 76 provided in the main body 68. The support shaft 76 is disposed in an upper portion of the main body 68, and the rear support plate 70 has a plate portion extending downward from the support shaft 76. A lower edge of the rear support plate 70 is fitted in a guide groove 77 formed in the bottom plate 62. A spring 78 for resiliently biasing the rear support plate 70 forward is incorporated in the main body 68. The rear support plate 70 is pivotal about the support shaft 76 by a biasing force of the spring 78, whereby the lower portion thereof moves forward away from the front face 69 of the main body. The biasing force of the spring 78 has such a strength that the rear support plate 70 is substantially flush with the front face 69 of the main body as shown in FIG. 5A when the sheet stack P has a greater thickness, and is shifted forward to support the rear end of the sheet stack P, as shown in FIG. 5B, as the volume of the sheets is reduced.

The rear support plate 70 has a hook 79 which projects rearward from a lower middle portion thereof for restriction of the forward pivotal movement of the rear support plate 70.

The rear support plate 70 has a sheet press claw 80 which extends upward from a portion thereof engaged with the support shaft 76. The sheet press claw 80 projects forward from the front face 69 of the main body when the rear support plate 70 is substantially flush with the front face 69 of the main body. As shown in FIG. 5A, the rear support plates 70 become flush with the front face 69 of the main body, when the sheet stack P has a greater thickness. Where 500 sheets are stacked in the sheet cassette, for example, the top of the sheet stack P is located adjacent the sheet press claws 80 as shown in 5A. The sheet press claws 80 serve to stop the rear upper edge of the sheet stack P to prevent the uppermost sheet of the sheet stack P from escaping rearward beyond the main body 68.

An extension portion 81 extends from a lower side portion of each of the rear support plates 70, and an insert 82 projects rearward from an end of the extension portion 81. The insert 82 is inserted in the space 72 defined between the main body 68 and the hook 71. The insert 82 has a thickness which is slightly smaller than the width of the space 72, but may have a thickness which is substantially equal to the width of the space 72. In this embodiment, the insert 82 is provided with projections 83 because the thickness of the insert 82 is slightly smaller than the width of the space 72. When the projections 83 of the insert 82 enter the space 72, the width of the space 72 is virtually occupied by the thickness of the insert 82 and the projections 83.

With this arrangement, where the sheet stack P has a greater thickness, as shown in FIG. 5A, the rear support plates 70 are pressed by a force exerted thereon by the weight of the sheet stack P thereby to be substantially flush with the front face 69 of the main body 68. At this time, there is no possibility that the uppermost sheet of the sheet stack P escapes rearward beyond the main body 68, because the sheet press claws 80 project from the front face 69.

Figure 6A:
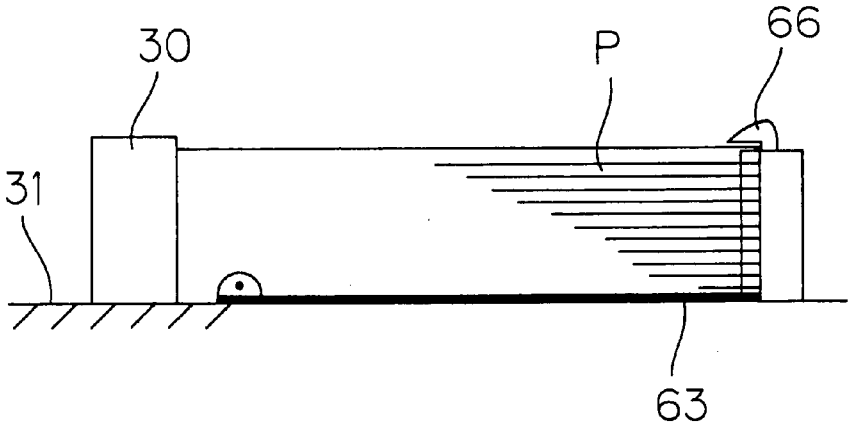
FIGS. 6A and 6B are schematic diagrams for explaining states of the sheet cassette assumed when a sheet stack has a greater thickness and when the sheet stack has a smaller thickness, respectively.
Figure 6B:
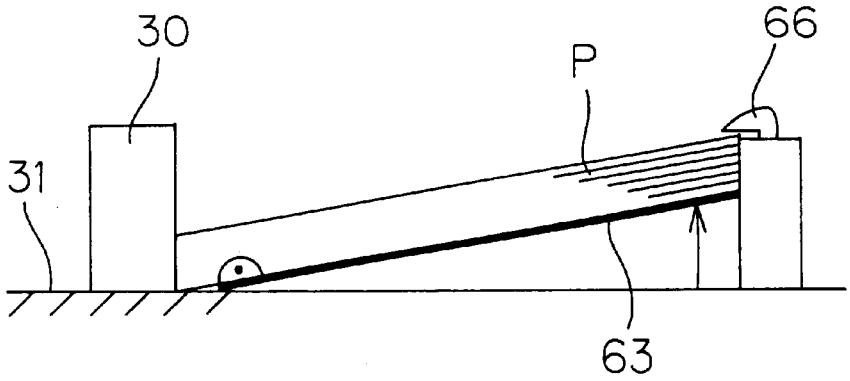

When the volume of the sheet stack P is reduced, on the other hand, the front portion of the sheet stack P is lifted by the bias plate 63 as shown in FIG. 6B, so that the sheet stack P tends to be curved apart from the separation claws 66. For prevention of this tendency, the rear support plates 70 support the rear end of the sheet stack P as shown in FIG. 5B. Therefore, the front portion of the sheet stack P is kept in intimate contact with a front portion of the bias plate 63, so that the upper front edge of the sheet stack is properly caught by the separation claws 66.

Where the sheet stack P has a greater thickness as shown in FIG. 5A, there would be a possibility that the restriction member 65 is disengaged from the bottom plate 62 by a force exerted thereon by the weight of the sheet stack. The disengagement of the restriction member 65 from the bottom plate 62 could occur only when the hooks 71 are disengaged from the attachment holes 67, and the disengagement of the hooks 71 from the attachment holes 67 could occur only when the hooks 71 are deformed toward the spaces 72. In this embodiment, however, the inserts 82 are respectively inserted in the spaces 72 with the rear support plates 70 being substantially flush with the front face 69 of the main body, when the sheet stack P has a greater thickness. Therefore, the hooks 71 cannot be deformed toward the spaces 72. Thus, the hooks 71 are prevented from being disengaged from the attachment holes 67.

It should be understood that the sheet trailing edge restriction member according to the present invention is not limited to the embodiment described above, but various modifications may be made within the scope of the present invention as defined in the following claims.

What is claimed is:

1. A sheet holder for holding a multiplicity of sheets for use in an image forming apparatus, the sheet holder comprising:

a sheet holding portion on which the sheets are stacked; and a restriction member detachably mounted in a predetermined position depending on a sheet size in the sheet holding portion for positioning a rear end of the sheet stack held in the sheet holding portion, wherein the restriction member comprises:

a main body disposed upright in the sheet holding portion;

a hook extending alongside the main body with a predetermined space defined therebetween for fixing the main body to the sheet holding portion, the hook being deformable toward the space so as to be brought into and out of engagement with the sheet holding portion;

a rear support plate forwardly displaceable from the main body so that, when the sheet stack has a greater thickness with a greater number of sheets held in the sheet holding portion, the rear support plate is pressed against the main body by the rear end of the sheet stack thereby to be substantially flush with the main body and, as the number of the sheets is reduced, the rear support plate is displaced forward from the main body to support the rear end of the sheet stack; and an insert projecting from the rear support plate to be inserted in the space between the main body and the hook, the insert being movable in accordance with the displacement of the rear support plate so as to be brought out of the space when the rear support plate is displaced to a forward terminal position.

2. A sheet trailing edge restriction member adapted to be detachably mounted in a predetermined position depending on a sheet size in a sheet holding portion for positioning a rear end of a sheet stack held in the sheet holding portion, the restriction member comprising:

a main body disposed upright in the sheet holding portion;

a hook extending alongside the main body with a predetermined space defined therebetween for fixing the main body to the sheet holding portion, the hook being deformable toward the space so as to be brought into and out of engagement with the sheet holding portion;

a rear support plate forwardly displaceable from the main body so that, when the sheet stack has a greater thickness with a greater number of sheets held in the sheet holding portion, the rear support plate is pressed against the main body by the rear end of the sheet stack thereby to be substantially flush with the main body and, as the number of the sheets is reduced, the rear support plate is displaced forward from the main body to support the rear end of the sheet stack; and an insert projecting from the rear support plate to be inserted in the space between the main body and the hook, the insert being movable in accordance with the displacement of the rear support plate so as to be brought out of the space when the rear support plate is displaced to a forward terminal position.

3. A sheet trailing edge restriction member as set forth in claim 2, wherein the main body has a front face to be opposed to the rear end of the sheet stack, wherein the rear support plate is vertically incorporated in the front face of the main body, and a lower portion of the rear support plate is forwardly displaceable pivotally about a support shaft provided in an upper portion of the front face.

4. A sheet railing edge restriction member as set forth in claim 3, wherein the insert projects rearwardly from the rear support plate, and has a thickness which is slightly smaller than the width of the space defined between the main body and the hook.

5. A sheet trailing edge restriction member as set forth in claim 4, wherein the hook includes a pair of hooks respectively provided alongside laterally opposite side faces of the main body, and the rear support plate includes a pair of rear support plates disposed in juxtaposition as viewed from the front face of the main body, wherein the pair of rear support plates respectively have inserts which are inserted in spaces defined between the main body and the hooks.

6. A sheet trailing edge restriction member as set forth in claim 5, wherein the rear support plate has a sheet press claw extending upward from the support shaft, and the sheet press claw is adapted to project forward from the upper portion of the front face of the main body when the rear support plate is substantially flush with the main body.

* * * * *